US008001713B2

(12) United States Patent
Bair

(10) Patent No.: US 8,001,713 B2
(45) Date of Patent: Aug. 23, 2011

(54) IMAGE DISPLAY DEVICE

(76) Inventor: Helen Bair, Edina, MN (US)

( * ) Notice: Subject to any disclaimer, the term of this patent is extended or adjusted under 35 U.S.C. 154(b) by 135 days.

(21) Appl. No.: 12/321,074

(22) Filed: Jan. 15, 2009

(65) Prior Publication Data

US 2010/0175289 A1 Jul. 15, 2010

(51) Int. Cl.
*A47G 1/06* (2006.01)

(52) U.S. Cl. ..... 40/771; 40/649; 40/661; 40/767; 40/776

(58) Field of Classification Search ..... 40/649, 40/661, 661.03, 766, 767, 776, 771
See application file for complete search history.

(56) References Cited

U.S. PATENT DOCUMENTS

| | | | | | |
|---|---|---|---|---|---|
| 4,310,976 | A * | 1/1982 | Wilten | 40/737 |
| 5,075,991 | A | 12/1991 | Wenkman et al. | 40/781 |
| D342,180 | S * | 12/1993 | Kirlin | D6/567 |
| 5,269,083 | A | 12/1993 | Vampatella et al. | 40/711 |
| 5,309,659 | A | 5/1994 | Eastman | 40/600 |
| 5,331,758 | A * | 7/1994 | Romick | 40/661 |
| 5,456,034 | A * | 10/1995 | Lewis et al. | 40/666 |
| 6,052,933 | A | 4/2000 | Lytle | 40/711 |
| 6,263,603 | B1 * | 7/2001 | Wildrick | 40/661 |
| 6,523,290 | B1 * | 2/2003 | Hanna et al. | 40/661 |
| 6,745,508 | B1 * | 6/2004 | Ngan | 40/642.02 |
| 2003/0079392 | A1 * | 5/2003 | Newman | 40/661 |
| 2006/0162213 | A1 * | 7/2006 | Einarson | 40/765 |
| 2006/0179699 | A1 * | 8/2006 | Gemmell | 40/661 |
| 2006/0254106 | A1 * | 11/2006 | Fast | 40/661.03 |

* cited by examiner

*Primary Examiner* — Gary C Hoge
(74) *Attorney, Agent, or Firm* — Mark A. Litman & Associates, P.A.

(57) ABSTRACT

An image support device has a support surface having a front face, a back surface, a bottom and a top. The support surface has secured thereto a visible light transmitting panel. The light transmitting panel preferably has a hinge towards the bottom of the support surface enabling a top of the light transmitting panel to be pulled away from the support surface in a non-destructive manner to create an opening behind the light transmitting panel. The opening behind the light transmitting panel is able to close and return to a closed position by elastic or spring tension to provide tension to an image placed behind the light transmitting panel. The top or the back of the support surface may have at least part of a wall connecting system attached thereto, or the opening may face away from a bottom of the device having a flat support base.

8 Claims, 2 Drawing Sheets

IMAGE DISPLAY DEVICE

BACKGROUND OF THE INVENTION

1. Field of the Invention

The present invention relates to the field of displays, especially hard copy displays and more particularly to image or sign displays. Most particularly the invention relates to photographic-type image displays on relatively flat panel devices, either individually or on connected sets of flat panel devices (e.g., in series, as connected by chains, ropes, cords, posts and the like).

2. Background of the Art

For many years, images have been displayed in frames, whether paintings in wooden frames of more recently photographic-type images displayed on backings in frames without covers or with covers of glass plates or transparent polymeric film. The most common photographic image-type display has a solid frame (metal, wood or polymer), a rigid backing (e.g., cardboard or other structural material) and a cover to physically protect an image (e.g., photograph) that is to be displayed in the frame. The image is presented face outwardly, with the image pressed against the glass, a backing surface pressed against the rigid backing and the solid frame supporting the image sandwiched between the glass and backing.

A consistent problem with frame displays is the difficulty in balancing ease of insertion of the image, protection of the image (both against abrasion and against UV, visible or IR radiation deterioration of the image), and physical stability of the image in the frame.

One of the most common picture frame displays has dog-ears or flanges that are pivotally fixed to the solid frame (e.g., a quadrangular frame with opening therein for picture display), the flanges extending over the rigid backing. The flanges may be turned at or past parallel to the lines of the solid frame, allowing the rigid backing to be removed, and the image inserted between the rigid backing and the face (e.g., glass) supported in the solid frame. There are usually at least about four (4) flanges. These flanges often bend, cut into the rigid backing (especially when cardboard), distort the backing and become more and more difficult over time to use when replacing the images.

Other various frames of interest as background information include, by way of non-limiting examples, U.S. Pat. Nos. 6,052,933; 5,309,659; 5,269,083; and 5,075,991.

SUMMARY OF THE INVENTION

A device having at least one frame element therein is used to display images such as photographs, prints, pictures, drawings, and other images manually, chemically or electronically prepared. The device comprises at least one structural backing layer (which may be flat, plane, ornate, curved, have ridges, plane edges or elevated decorative edges, as with conventional frames), and may have many variable designs, but with at least one unifying structural feature. Secured to an image display surface is a display panel that is fixed or hinged along one edge so that a second edge or side of the panel opposite the fixed or hinged edge may be raised the second edge is lifted away from the structural backing without the necessity of unlocking the second edge (except possibly by direct force against a snap or the like). The lifting of the second edge exposes a space between the display panel (which has at least one transparent or translucent area therein, through which an image may be viewed) and the structural backing. An image may be inserted directly in the space between the display panel and the structural backing, the panel released (if maintained open by force) and the panel repositioned against the structural backing layer to support, protect and display the image.

DETAILED DESCRIPTION OF THE INVENTION

An image display device is provided. The image display device will have at least two identifiable components thereon, although it is possible to manufacture the device so that the two identifiable components are structurally continuous, as explained later. The at least two components comprise a structural support backing that has a first surface area (e.g., projected surface area). The second identifiable component is a display panel having a second surface area (e.g., projected surface area). The second surface area is smaller than the first surface area, so that at least some (if not all) edges of the having at least one frame element therein is used to display images such as photographs, prints, pictures, drawings, and other images manually, chemically or electronically prepared. The device comprises at least one structural backing layer (which may be flat, plane, ornate, curved, have ridges, plane edges or elevated decorative edges (as with conventional frames, and may have many variable designs, but with at least one unifying structural feature. Secured to an image display (or image carrying) surface is a display panel that is fixed or (elastically) hinged along one edge so that when a second edge or side of the panel opposite the fixed or hinged edge pulled or lifted, the second edge is lifted away from the structural backing without the necessity of unlocking the second edge (except possibly by direct force against a snap or the like) and without detaching the hinged edge. The lifting of the second edge exposes a space between the display panel (which has at least one transparent or translucent area therein, through which an image may be viewed) and the structural backing. An image may be inserted directly in the space between the display panel and the structural backing, the panel then (e.g., elastically) returning to a closed position to retain the image. The opening is preferably on a lower or bottom portion of the device. That is, the bottom or lower portion would rest on a support (e.g., table) or be facing the device is hung on a wall.

An underlying benefit of this construction is that images may be replaced very rapidly, the images are stable in the frame, the frames may be moved and repositioned easily, and the frame is durable.

Reference to the Figures will assist in an appreciation of the structure and function of frames according to the present technology.

Figure 1:
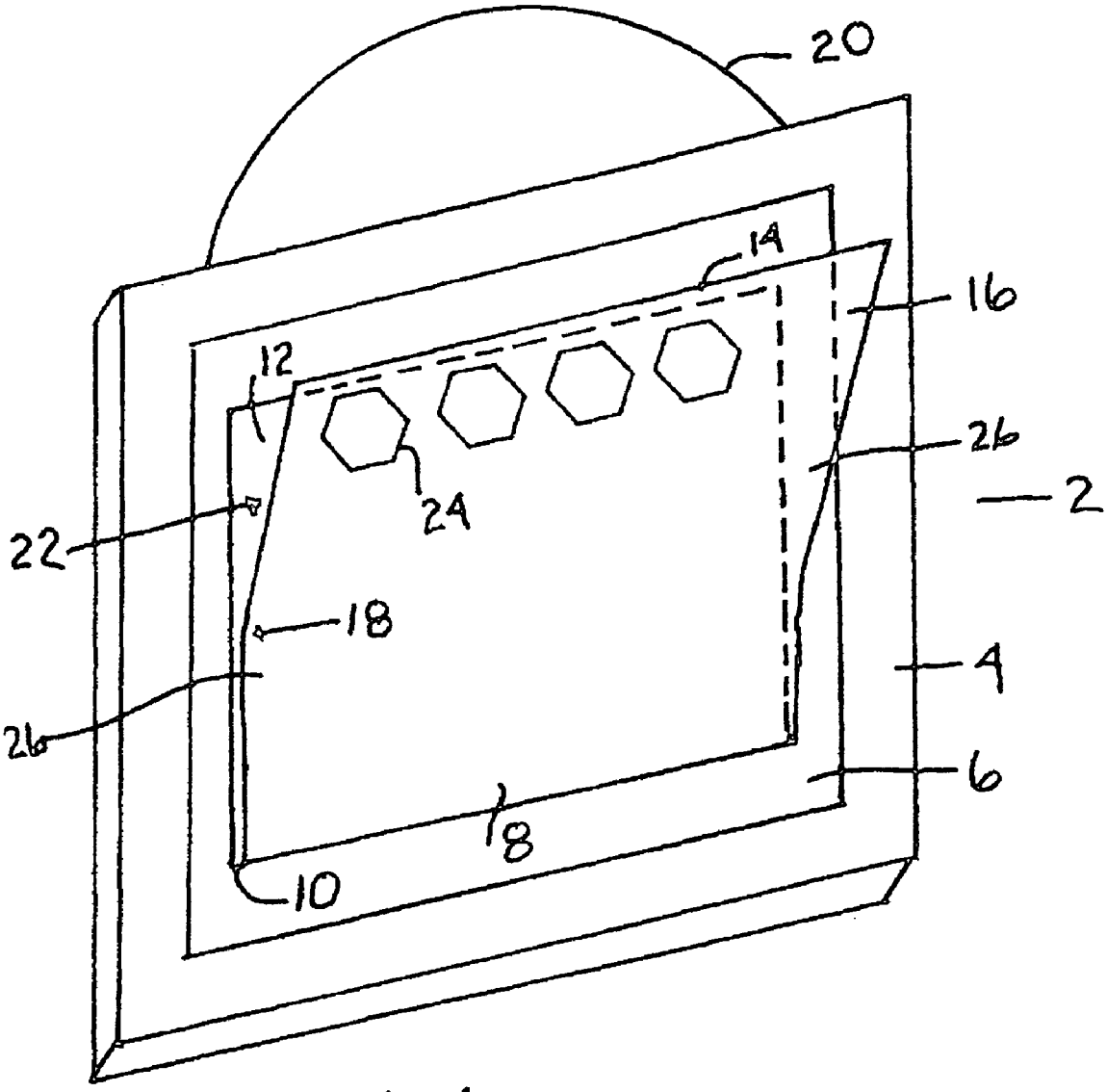
FIG. 1 shows a perspective view of an opened frame according to the invention with an image to be displayed being inserted therein.

FIG. 1 shows a frame 2 according to the present invention. The frame 2 has a surrounding defining support 4 here shown as a quadrilateral rigid support (it may be flexible also) made of metal, wood, polymer, ceramic, composite material, stiff elastomeric material or the like). The defining support 4 carries an interior support surface 6 which may be opaque, translucent or transparent. The interior support surface 6 may be flat, curved, continuous, porous or the like. Each of these elements 4 and 6 may be rigid or flexible without affecting the practice of the present technology.

Attached to the interior support surface 6 is shown the at least front face 16 flexible image support element 8. The image support element 8 shown in FIG. 1 has a front face 16 and a back face 12 that form a living hinge 10 (or flex point or connection) between the front face 16 and the back face 12. FIG. 1 shows the back face 12 extending approximately coextensively with the front face 16, but this is not essential. The faces 12 and 16 may be of different lengths, especially with the back face 12 being shorter than the front face 16 as long as the living hinge 10 or flex point is created.

As shown in the Figure, as the top 14 of the front face 16 is pulled forward, exposing the back face 12, a gap 22 is created between the two faces 12 and 16. This gap may be, in part, created by some flexing 18 in the front face 16 or not. As long as there is some living hinge effect or bending/flexing of the front face 16 that allows an image to be slid into the gap 22 with minimal resistance, the frame 2 will perform as desired. It is also possible to have an actual tensioned (e.g., spring supported) hinge at the position or slightly above the position of the living hinge 10 shown in FIG. 1.

The front face 16 of the image support element 8 may have either decorations 24 adhered thereon, which in sufficient numbers and locations can adjust flexibility and stiffness of the front face 16 or more continuous elements (e.g., panels, flat plates, rods, etc.) may be added along the edges 26 to control the degree of flexing of the front face 16.

The front face 16 of the image support element 8 should be transparent or translucent, preferably colorless (less than 0.2 and preferably less than 0.1 transmission optical density to white light) to allow best viewing of the image. The system of this invention may have both the defining support 4 and the interior support surface 6*a* composite (e.g., the defining support 4 laminated to the interior support surface 6 or even to eliminate the defining support 4 and have the image support element 8 adhered to a flat panel comprising only the interior support surface 6 without any defining support 4. The image support element 8 would still perform as needed according to the present technology.

Figure 2:
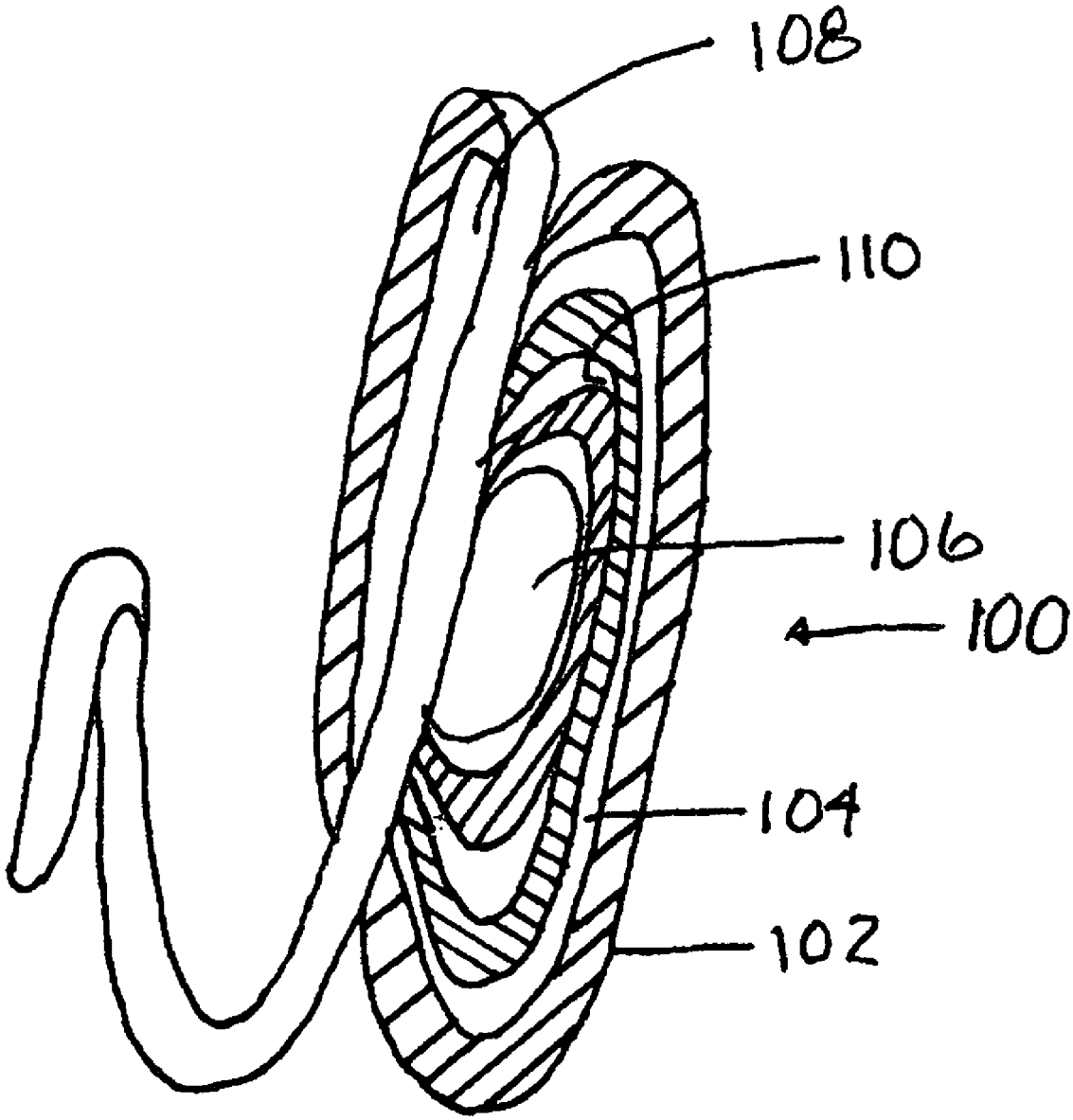
FIG. 2 shows a perspective view of a wall connecting device for use with frames with chains or elongate supports on the frames.

An additional element that may be combined with the hanging or support element 20 of FIG. 1 is shown in FIG. 2. The clip, clamp or connector 100 has a flexible elongate element 102 that may have spaces 104 between the continuous elongate element 102 or there may be contact between adjacent sections of the elongate element 102 as shown at 110. A support element (e.g., elongate support 20 in FIG. 1) may be slid between adjacent sections of the elongate element 102 through initial opening 108 and then slid deeper through the loops of the connector 100, and then the initial opening may be supported on a wall hook, thereby supporting the frame 2 of FIG. 1. The clamp 100 is shown with a decorative element 106 (e.g., plastic, composite, stone, gem, metal, etc.) within the loops of the elongate element 102.

Various structural materials, with no criticality, may be used for each of the components of the device shown herein. For example, the frame 2, the interior support surface 6 or the defining support (or the interior support surface 6 alone if there is no defining support 4) may comprise polymeric materials, synthetic materials, natural materials, wood, thermoplastic resins, thermoset resins, ceramic, composites, metal and the like, function being provided by the physical and decorative properties of the material. The front face 8 of the image support element should preferably be transparent to white light to as to best display images. Polymeric materials are needed to provide both the flexibility and light transmission properties of the front face 8 of the image support element 16. Commercial frames consisting of a single piece of such polymers (e.g., polyester, polyacrylic resins, polyolefin resins, polyvinyl resins, copolymers and the like) may be used to form the image support element 16. These commercial frames may comprise a continuous element comprising a front face with a top side living hinge to a back panel (forming a sandwich between which sides images are slid either sideways between the sandwich or upward to the sandwich. The back panel continuously extends into a flopped or right angle horizontal support layer that acts as a support base for the entire element.

The technology of the present invention may be generally described as an image support device with a support surface having a front face, a back surface, a bottom and a top. The support surface has secured thereto a visible light transmitting panel (the front face of the image support element). The light transmitting panel having a hinge towards the bottom of the support surface enabling a top of the light transmitting panel to be pulled away from the support surface in a non-destructive manner to create an opening behind the light transmitting panel. The opening behind the light transmitting panel is able to return by elastic or spring tension to provide tension to an image placed behind the light transmitting panel. The top or the back of the support surface has at least part of a wall connecting system attached thereto. The support surface is preferably rigid and flat. The support surface may have a continuous frame extending along all edges of the support surface. The front face of the light transmitting panel may forms a living hinge with a flat back panel that is secured to the support surface such that when the top of the light transmitting panel is pulled forward, the flat back panel remains secured to the support surface. The support surface may have a continuous frame extending along all edges of the support surface that may be purely decorative or adjust tension along edges of the light transmitting panel. The light transmitting panel should have light transmitting properties in a polymer of white light transmission optical density of less than 0.2 or less than 0.1 as measured by a transmission spectrophotometer. A preferred embodiment of the device has the light transmitting panel and the flat back panel with a height that is between 2.5 and 6 inches and the top of the light transmitting panel can be pulled forward to create an opening of at least 0.25 inches without visibly cracking the living hinge after 500 repetitions of opening and closing to form a gap of 0.25 inches. This test can be performed manually, but a definitive test would comprises gripping the top edge with a right angled tool that grips the top, pulls the top edge forward to the at least 0.25 inch gap, holds the top extended in that position for 10 seconds, then allows the top to return to a stable position by elastic return until stopped by the support surface or a back panel of the image supporting device. This test is performed for 500 cycles at 20° C. within a twelve hour period. The top of the light transmitting panel rests against a resistant surface by elastic tension in the living hinge and no physical restraints are present that otherwise directly contact or restrain the top edge. The resistant surface may be the support surface or a back light transmitting panel element. The wall connecting device may be a first component comprising an elongate wire, string, cord or cable. The wall connecting device preferably has a continuous, coiled flexible material that has coils of the continuous, coiled flexible material looped through the first component to that when the continuous, coiled flexible material is supported, the first component is tensed and the device is supported.

The back panel of the light transmitting panel may have an opaque layer adhered to the back panel that has a transmission optical density of at least 0.8.

What is claimed:

1. An image support device comprising a frame and an interior support surface within the frame, the interior support surface having a front face, a back surface, a bottom and a top, the support surface having secured thereto a visible light transmitting panel, the light transmitting panel having a hinge towards the bottom of the support surface enabling a top of the light transmitting panel to be pulled away from the support surface in a non-destructive manner to create an opening behind the light transmitting panel;

the opening behind the light transmitting panel being able to return by elastic or spring tension to provide tension to an image placed behind the light transmitting panel; and the top or the back of the interior support surface having at least part of a wall connecting system attached thereto, wherein the front face of the light transmitting panel forms a living hinge with a flat back panel that is secured to the support surface such that when the top of the light transmitting panel is pulled forward, the flat back panel remains secured to the interior support surface, wherein the light transmitting panel comprises a light transmitting polymer having a white light transmission optical density of less than 0.2, wherein the light transmitting panel and the flat back panel have a height that is between 2.5 and 6 inches and the top of the light transmitting panel can be pulled forward to create an opening of at least 0.25 inches without visibly cracking the living hinge after 500 repetitions of opening and closing to form a gap of 0.25 inches, wherein the top of the light transmitting panel rests against a resistant surface by elastic tension in the living hinge and no physical restraints are present that otherwise directly contact or restrain the top edge, wherein the wall connecting device comprises a first component comprising an elongate wire, string, cord or cable, and wherein the wall connecting device further comprises a continuous, coiled flexible material that has coils of the continuous, coiled flexible material looped through the first component to that when the continuous, coiled flexible material is supported, the first component is tensed and the device is supported.

2. The device of claim 1 wherein the top of the light transmitting panel rests against a resistant surface by elastic tension in the living hinge and no physical restraints are present that otherwise directly contact or restrain the top edge.

3. An image support device comprising a frame and an interior support surface within the frame, the interior support surface having a front face, a back surface, a bottom and a top, the support surface having secured thereto a visible light transmitting panel, the light transmitting panel having a hinge towards the bottom of the support surface enabling a top of the light transmitting panel to be pulled away from the support surface in a non-destructive manner to create an opening behind the light transmitting panel;

the opening behind the light transmitting panel being able to return by elastic or spring tension to provide tension to an image placed behind the light transmitting panel; and the top or the back of the interior support surface having at least part of a wall connecting system attached thereto, wherein the front face of the light transmitting panel forms a living hinge with a flat back panel that is secured to the support surface such that when the top of the light transmitting panel is pulled forward, the flat back panel remains secured to the interior support surface, wherein the light transmitting panel comprises a light transmitting polymer having a white light transmission optical density of less than 0.2, wherein an opaque layer is secured to a surface of the flat back panel.

4. The device of claim 3 wherein the wall connecting device further comprises a continuous, coiled flexible material that has coils of the continuous, coiled flexible material looped through the first component to that when the continuous, coiled flexible material is supported, the first component is tensed and the device is supported.

5. The device of claim 3 wherein the top of the light transmitting panel rests against a resistant surface by elastic tension in the living hinge and no physical restraints are present that otherwise directly contact or restrain the top edge.

6. The device of claim 4 wherein the top of the light transmitting panel rests against a resistant surface by elastic tension in the living hinge and no physical restraints are present that otherwise directly contact or restrain the top edge.

7. An image support device comprising a frame and an interior support surface within the frame, the interior support surface having a front face, a back surface, a bottom and a top, the support surface having secured thereto a visible light transmitting panel, the light transmitting panel having a hinge towards the bottom of the support surface enabling a top of the light transmitting panel to be pulled away from the support surface in a non-destructive manner to create an opening behind the light transmitting panel;

the opening behind the light transmitting panel being able to return by elastic or spring tension to provide tension to an image placed behind the light transmitting panel; and the top or the back of the interior support surface having at least part of a wall connecting system attached thereto, wherein the front face of the light transmitting panel forms a living hinge with a flat back panel that is secured to the support surface such that when the top of the light transmitting panel is pulled forward, the flat back panel remains secured to the interior support surface, wherein the light transmitting panel comprises a light transmitting polymer having a white light transmission optical density of less than 0.2, wherein the back panel of the light transmitting panel has an opaque layer adhered to the back panel that has a transmission optical density of at least 0.8.

8. The device of claim 7 wherein the top of the light transmitting panel rests against a resistant surface by elastic tension in the living hinge and no physical restraints are present that otherwise directly contact or restrain the top edge.

* * * * *